US005409237A

United States Patent [19]

Marcley et al.

[11] Patent Number: 5,409,237

[45] Date of Patent: Apr. 25, 1995

[54] WORD FORMING CARD GAME

[76] Inventors: Fredrick R. Marcley; Gerald L. Marcley, both of 25 W. 15th Rd., Broad Channel, N.Y. 11693

[21] Appl. No.: 152,832

[22] Filed: Nov. 15, 1993

[51] Int. Cl.[6] ..... A63F 1/04

[52] U.S. Cl. ..... 273/299; 273/272; 434/172

[58] Field of Search ..... 273/272, 292, 299, 306, 273/308; 434/172

[56] References Cited

U.S. PATENT DOCUMENTS

| | | | |
|---|---|---|---|
| 1,012,574 | 12/1911 | Adams . | |
| 1,076,307 | 10/1913 | Nicholson . | |
| 1,312,278 | 8/1919 | Shinn | 273/299 |
| 1,542,819 | 6/1925 | Bloom | 273/299 |
| 2,000,812 | 5/1935 | Adams | 273/299 |
| 3,654,712 | 4/1972 | Bagdasar . | |
| 4,219,197 | 8/1980 | Acuff | 273/299 |
| 4,402,513 | 9/1983 | Head | 273/299 |
| 5,199,714 | 4/1993 | Harper . | |

*Primary Examiner*—Vincent Millin
*Assistant Examiner*—William M. Pierce
*Attorney, Agent, or Firm*—Collard & Roe

[57] ABSTRACT

A word rummy game includes two different decks of cards. The first deck includes a plurality of playing cards with each card having two sides with a letter on one side. Words are provided to each player while keeping these words secret from other players. This is accomplished through the use of a different second deck of mystery word cards. Every player then receives a predetermined number of letter playing cards and one mystery word card from the dealer while each player keeps his cards hidden from other players. Each individual player then uses his letter playing cards to form the given words on the word card. The first individual to match all of his letters to his given words wins the game.

1 Claim, 5 Drawing Sheets

WORD FORMING CARD GAME

BACKGROUND OF THE INVENTION

1. Field of the Invention

This invention relates to a word rummy game using standard size playing cards which are arranged and played consistent with the rules of rummy. In addition, this invention replaces the conventional four suit, two color single deck with two decks of cards, one deck containing letters and one deck containing words. The result is a combination of the two decks to form a game which combines letters on the playing cards from one deck to form the words on the mystery word cards of the other deck.

2. The Prior Art

U.S. Pat. No. 1,012,574 to Adams discloses a single deck of 53 cards for playing various games. Fifty two of the cards have characters inscribed thereon which represent the usual four suits of thirteen cards each, with each suit comprising king, queen, jack and ten spot cards. The other card in the pack is the joker card. This card may be blank or it may have the appropriate symbol inscribed thereon. Each card with the exception of the joker card bears the inscription of the suit, the appropriate value and letter of the alphabet. All 26 letters of the alphabet are represented on the card with the remaining cards duplicating the vowels and consonants most used.

U.S. Pat. No. 1,076,307 to C. M. Nicholson discloses a 72 card game using letters and numbers to make words and sentences. The cards are dealt to four or more players.

U.S. Pat. No. 3,654,712 to Bagdascar discloses a teaching aid kit for kindergarten and first grade children who are learning the alphabet and various sounds and letters.

U.S. Pat. No. 5,199,714 to Harper discloses a deck of 52 standard sized playing cards with 50 cards each having one letter on its obverse side and two wild cards. The blanks stand for any letter of the alphabet. The cards are arranged and combined in a word forming game following the general organizational principles of Klondike solitaire.

SUMMARY OF THE INVENTION

It is therefore the object of the invention to provide a plurality of cards in two different decks to create a word rummy game.

Another object of the invention is to provide a card game based upon a method for completing words using playing cards, each containing a letter of the alphabet.

Still another object of the invention is to create a card game in which all the players compete to complete known words using their individual letter playing cards.

According to the present invention, there is a first deck of playing cards representing either a single letter of the alphabet with all letters from A to Z represented, or a wild card. The wild cards can represent any letter in the alphabet. There is also a different second deck for containing only words printed on these mystery word cards where the word cards have one word or several words of unequal length inscribed on one side of the word cards. These words are sorted into three different word sets: small, medium and large, with each word set having words of equal length throughout the deck.

The mystery word deck is preferably made up of 50 cards. Each card preferably contains three words: a five letter word, a four letter word and a three letter word. The three-word contents in each mystery word card is intended not to repeat the same letter more than twice in all three words combined. The reason for this is that when there are four people playing, it is impossible to expend more than eight duplicate letters in the same game (since the playing deck contains only eight duplicates of every letter of the alphabet).

The letters and the words can be from any alphabet such as English, Greek, Russian, Hebrew or Aramaic, with English being preferred. The letter cards and wild cards of the first deck are used to form the words located on the word cards of the second deck. The player who first completes the prescribed words on the word cards using the letter and wild cards from the playing card first deck wins the game.

Each card in both of the two decks has two sides, a front or obverse side, and a back or reverse side. Letters of the alphabet are inscribed on one side only, of the letter cards, while mystery words are inscribed on one side only of the word cards.

The present invention, also includes a method for playing the card game which provides a first plurality or deck of letter playing cards having two sides, with the cards having a letter of the alphabet on one side. Additionally there is a second plurality or deck of mystery word cards having two sides, with each word being from a different predetermined word set. Each word set contains words of the same length with every card having a word from each word set. A player receives a predetermined number of playing cards and one of the word cards to hold in his hand so that the player can then compare the letters on the playing cards to the letters on the word card. Two piles of cards are arranged with one pile having discarded letter playing cards face up and another pile of cards having letter playing cards face down. The players then alternately draw and discard letter cards from the face down pile of the two piles to find the combination of letter cards which match the words on the word card. When the letters of the playing cards complete all the words on the word card, that player wins the game.

The players can select wild cards which would substitute as letter playing cards where the wild cards could signify any letter in the alphabet.

In a second embodiment of the method according to the invention for playing the card game each player can also expose the mystery word cards to the other players at the start of the game. Thus, the players compete to rid themselves of the letter playing cards by matching their letter playing cards to complete the words shown on the exposed word cards. Once a word has been matched to letters, the word and the letters are removed from play. The first player to match all of his letters to the exposed words wins the game.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
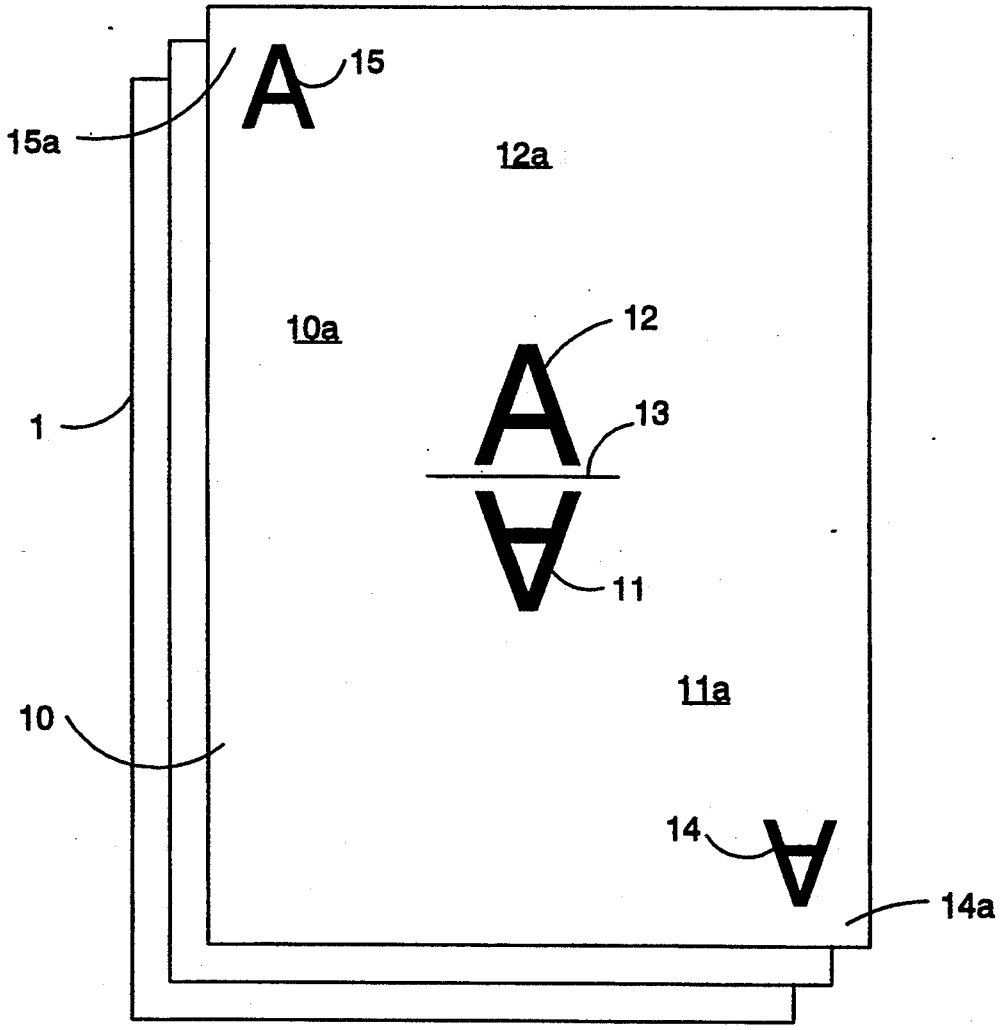
FIG. 1 is a top view of the obverse side of a letter playing card.

Referring now in detail to the drawings, FIG. 1 shows the obverse side 10*a* of the letter playing card 10 of a first deck 1. Card 10 has enlarged lettering 11 on one half 11*a* of the card with a mirror image of the lettering 12 on the other half 12*a* of the card. The two halves are divided by a line 13 comprising the lateral axis of the playing card. On this side, 10*a* are two smaller letters 14 and 15, with one letter 14 in the lower right corner 14*a* and another letter 15 in the upper left hand corner 15*a* diagonally opposite the lower right-hand corner. This letter card 10 is used to denote all the letters of an alphabet. Preferably, there are 208 letter playing cards based upon 26 letters of the alphabet repeated 8 times.

Figure 2:
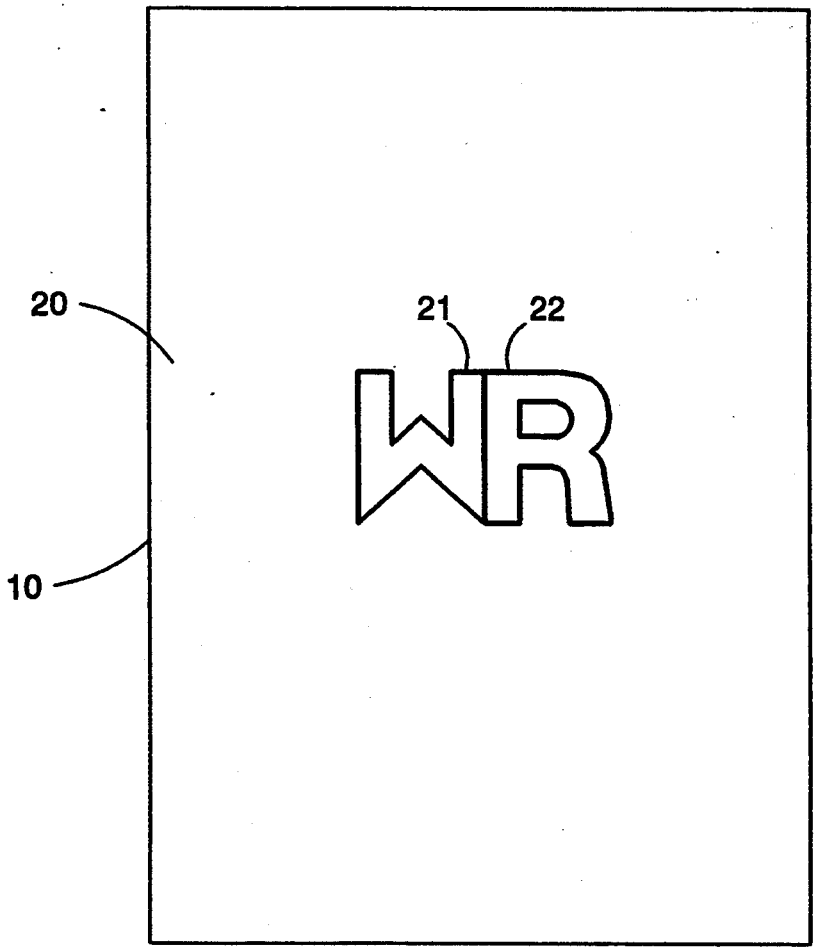
FIG. 2 is the reverse side of the letter playing card of FIG. 1.

FIG. 2, shows the reverse side 20 of the letter playing card 10. On side 20 of the letter card is lettering 21, and 22 which denote "WR" (Word Rummy) and which are placed approximately in the center of the card face. This reverse side is repeated for all 210 cards to complete the reverse side of the 208 letter cards 10 plus the two wild cards 50 (FIG.5).

Figure 3:
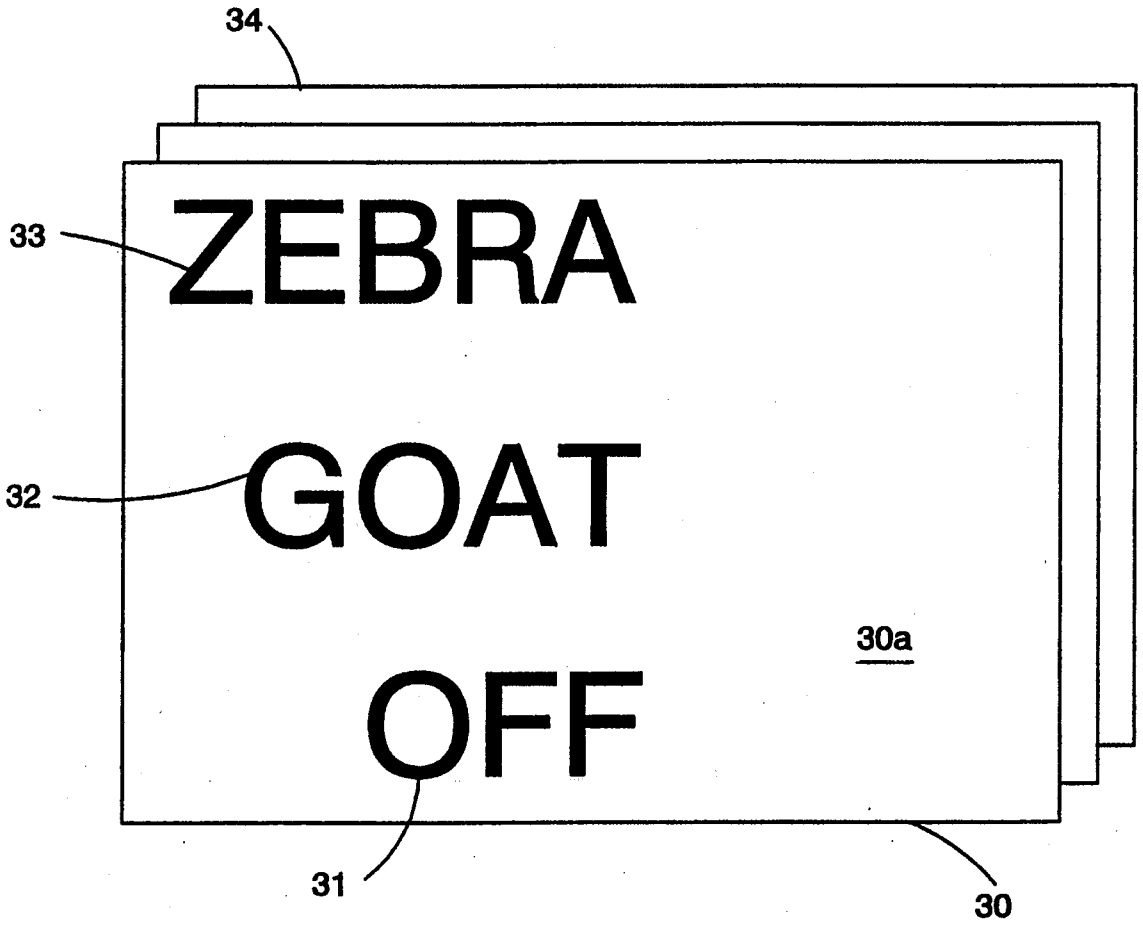
FIG. 3 is the obverse side of a mystery word card containing three different words.

FIG. 3 shows an example of the mystery word card 30 of a different second deck 34. On the obverse side 30*a* are three words each of different length. The first word 31 is a three letter word taken from a first set of three letter words. The second word 32 is a four letter word taken from a second set of four letter words. The third word 33 is a five letter word taken from a third set of five letter words.

Figure 4:
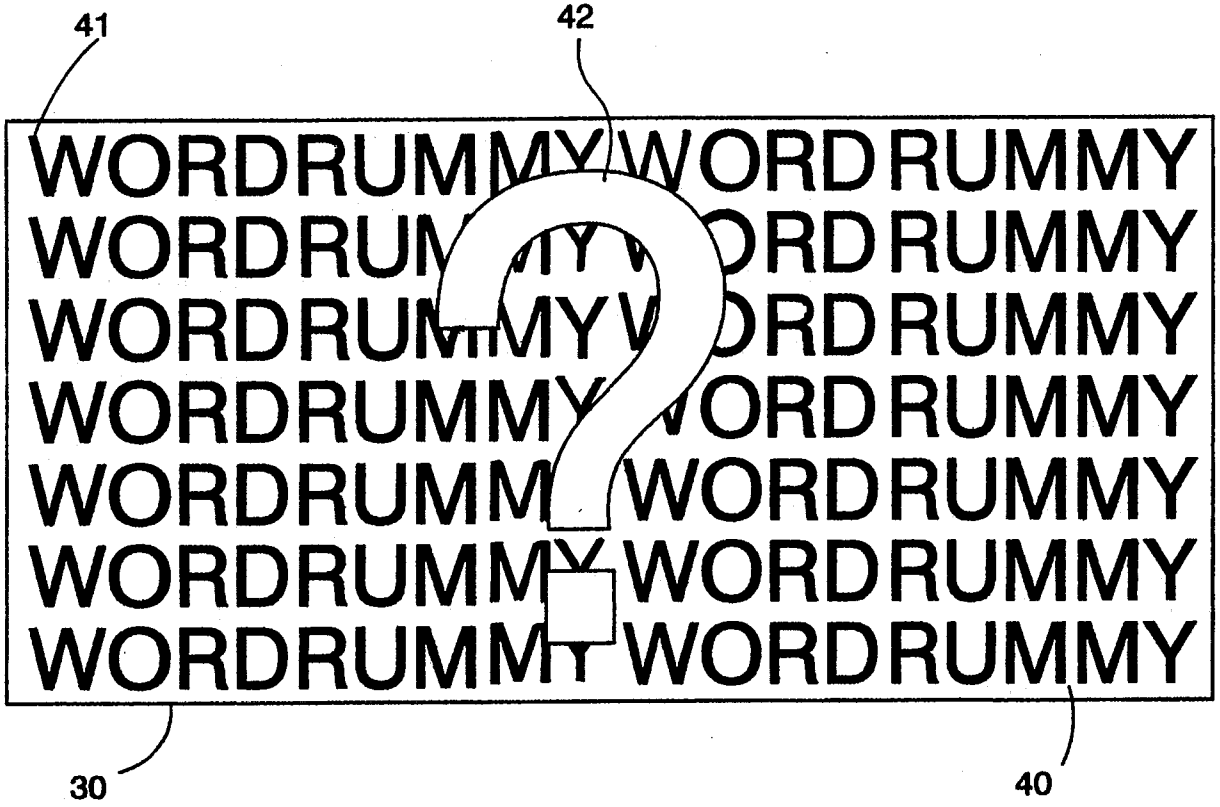
FIG. 4 is the reverse side of the mystery word card of FIG. 3.

FIG. 4 shows the reverse side 40 of the mystery word card 30. This side 40 has words 41 inscribed in succession thereon. In addition, there is a large question mark 42 placed in the center of the card.

Figure 5:
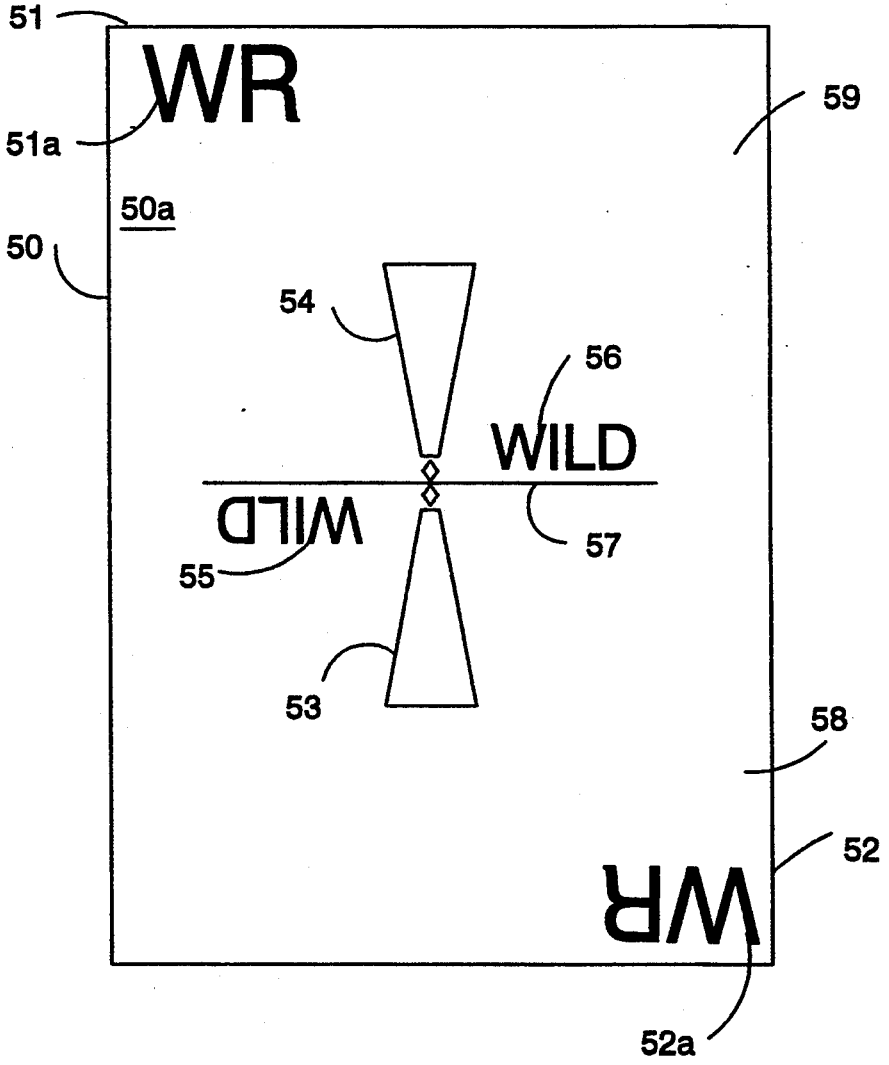
FIG. 5 is the obverse side of a wild card.

FIG. 5 shows the obverse side 50*a* of the wild card 50. In the top left corner 51 is lettering 51*a*. In the lower right hand corner 52 is lettering 52*a* inscribed thereon. The card face 50*a* has a lateral axis dividing line 57 separating it into halves 58 and 59. Exclamation point 53 is on one half 58 with exclamation point 54 on the other half 59. Words 55, 56 are placed on both sides of the dividing line adjacent to the exclamation points 53, 54, respectively. This wild card has the same reverse side 20 as the other letter playing cards 10, allowing players to conceal the presence of their wild cards.

One embodiment of the word rummy game is played in the following manner. First, each player draws one mystery word card 30 from a different second deck 34 of fifty cards. The mystery word card 30 is kept secret and assigns three words to each player; a five letter word 33, a four-letter word 32, and a three-letter word 31. Then the dealer deals each player twelve playing cards 10 from a deck of letter playing cards. The first playing deck includes 210 letter cards which features all 26 letters of the alphabet (eight duplicate cards per letter) plus two wild cards 50. After the dealer finishes dealing these cards, he places the first playing deck face-down in the middle of the table. This face down first playing deck then becomes the draw pile. Then the dealer takes the top card from the draw pile and places it face up next to the draw pile. This new face up card then becomes the base for the discard pile. However, if the top card taken from the draw pile is a wild card, then the wild card is placed in the middle of the draw pile and another card is drawn. Every player keeps his letter playing cards 10 and mystery word cards 30 concealed from everyone else. The object of the game is to be the first player to obtain all the letters required to spell out all three words on his mystery word card by drawing and discarding playing cards in a rummy-like manner.

Another embodiment of this game is played the following manner. Each player draws a mystery word card 30 and places it face-up in the middle of the table. The dealer then deals twelve letter playing cards 10 to each player. The first player to spell out a three letter word 31, a four letter word 32, and a five letter word 33 wins. However, in this case, once a player spells any of the three letter words, four letter words, or five letter words in the mystery word cards, that player discards the letters spelling his word face up in front of him. That word and those playing cards are then removed from play and the game continues. Each player then continues to play with his remaining number of cards and draws and discards in turn as in the usual manner in a rummy game. A player is not permitted to discard the same word as another player. In other words, once someone discards a word, no one else is allowed to use the same word.

The following Table contains a list of word combinations useful for the word cards.

TABLE

LIST OF TRIPLE WORD COMBINATIONS USEFUL FOR A WORD CARD

| NO. | 5 LETTERS | 4 LETTERS | 3 LETTERS |
|---|---|---|---|
| 1. | SEVEN | GNAT | INK |
| 2. | ACUTE | XRAY | DOG |
| 3. | GLASS | ZOOM | MAP |
| 4. | GROSS | AXIS | CAT |
| 5. | IGLOO | EARN | GUN |
| 6. | ABYSS | GAME | DIG |
| 7. | HEAVY | DISH | BIN |
| 8. | ENTER | QUIT | FOG |
| 9. | GREEN | PACK | ANT |
| 10. | OCCUR | BORE | HIP |
| 11. | PLACE | CROP | MAN |
| 12. | PLUTO | BOAT | INN |
| 13. | UNION | PLAY | EGG |
| 14. | DRIVE | OPEN | CAR |
| 15. | CRAVE | NEXT | JOB |
| 16. | VIXEN | MASH | RUN |
| 17. | BRICK | ONYX | FEW |
| 18. | DRINK | MOLE | YAM |
| 19. | EXTRA | DRIP | TOP |
| 20. | BROOM | CLAM | SEW |
| 21. | HAVEN | UNIT | ZOO |
| 22. | WATER | SHOE | LOW |
| 23. | WATCH | FLEW | RIM |
| 24. | KNACK | EASY | ORE |
| 25. | JACKS | GROW | AND |
| 26. | FLUME | LEFT | ACT |
| 27. | PLANE | VAST | NOT |
| 28. | GROUP | JUMP | KEY |
| 29. | MONEY | GLUE | VAN |
| 30. | ZEBRA | GOAT | OFF |
| 31. | RADIO | TUBE | FLY |
| 32. | BLIMP | TEST | LAD |
| 33. | BOXER | LAZY | ARM |
| 34. | CLOCK | FAKE | LID |
| 35. | CANAL | NEST | POT |
| 36. | QUICK | PAGE | END |
| 37. | RIGHT | FAME | NOD |
| 38. | NIGHT | KING | EWE |
| 39. | FLOAT | STEW | WIN |
| 40. | MARRY | MILK | TOE |
| 41. | HAPPY | ECHO | FIN |
| 42. | APPLE | WEST | KIT |
| 43. | FIGHT | RAIN | BET |
| 44. | STORE | NAIL | YES |
| 45. | FLOOR | HUGE | JAR |
| 46. | FLAME | IDOL | NET |

TABLE-continued

| LIST OF TRIPLE WORD COMBINATIONS USEFUL FOR A WORD CARD | | | |
|---|---|---|---|
| NO. | 5 LETTERS | 4 LETTERS | 3 LETTERS |
| 47. | QUIET | HERO | TAR |
| 48. | ABOUT | IRON | GET |
| 49. | NORTH | LACE | CAN |
| 50. | SOUTH | YARN | HAT |

While only two embodiments of the present invention have been shown and described, it is to be understood that many changes and modifications may be made thereunto without departing from the spirit and scope of the invention as defined in the claims.

What is claimed is:

1. A game comprising:

a first deck containing two hundred ten cards, each having a front surface and a back surface, two hundred eight cards containing eight of every letter of the alphabet on the front surface of each card, and two wild cards, with the word "wild" on the front surface of the two wild cards, all two hundred ten cards in the first deck having a logo on the back surface;

a second deck containing fifty cards, each having a front surface and a back surface, each card of the second deck containing a series of three words, a three-letter word, a four-letter word, and a five-letter word on the front surface, and a logo on the back surface thereof;

said series of three words repeating the same letter of the alphabet no more than twice in all three words combined; and whereby the game is played by a plurality of players, but no more than four players, each of whom is dealt twelve cards from the first deck and one card from the second deck, each player then drawing and discarding cards of said first deck so as to acquire the letters of the words on the card that was dealt from the second set.

* * * * *